United States Patent [19]

Amende et al.

[11] Patent Number: 4,617,070

[45] Date of Patent: Oct. 14, 1986

[54] METHOD OF MAKING WEAR-RESISTANT CYLINDER, OR CYLINDER LINER SURFACES

[75] Inventors: Welf Amende, Munich; Wolfram Lausch, Augsburg; Hartwin Zechmeister, Munich, all of Fed. Rep. of Germany

[73] Assignee: M.A.N. Maschinenfabrik Augsburg-Nurnberg Aktiengesellschaft, Augsburg, Fed. Rep. of Germany

[21] Appl. No.: 677,172

[22] Filed: Dec. 3, 1984

[30] Foreign Application Priority Data

Dec. 3, 1983 [DE] Fed. Rep. of Germany ..... 3343783

[51] Int. Cl.[4] ..... C21D 1/06

[52] U.S. Cl. ..... 148/152; 148/4; 148/321; 148/903; 148/910

[58] Field of Search ..... 148/4, 14, 145, 152, 148/39, 35, 1, 134; 219/121 L, 121 LM, 121 LE, 121 LF, 121 LS

[56] References Cited

U.S. PATENT DOCUMENTS

| | | | |
|---|---|---|---|
| 4,093,842 | 6/1978 | Scott | 148/145 |
| 4,304,978 | 12/1981 | Saunders | 219/121 L |
| 4,313,771 | 2/1982 | Lorenzo et al. | 148/14 |
| 4,452,647 | 6/1984 | Sailas | 148/145 |

*Primary Examiner*—L. Dewayne Rutledge
*Assistant Examiner*—S. Kastler
*Attorney, Agent, or Firm*—Frishauf, Holtz, Goodman & Woodward

[57] ABSTRACT

In order to prevent the formation of fissures or tears in the walls of cylinders of an internal combustion engine, hardening tracks (4) generated by a carbon dioxide laser, are placed parallel to each other at an angle of inclination ($\alpha$) with respect to the axis (3) of the wall of the cylinder or cylinder liner, and spaced from each other by a distance (X) which is greater than twice the distance (k) between the maxima (9, 10) of tension resulting in the operation of the ICE from the edges of the hardening track, thereby satisfying the condition: X is greater than $2 \times k$.

5 Claims, 5 Drawing Figures

METHOD OF MAKING WEAR-RESISTANT CYLINDER, OR CYLINDER LINER SURFACES

Reference to related patent and publication: U.S. Pat. No. 4,093,842 "Maschinemarkt", Würzburg 86 (1980) 96, pp. 1915–1918.

The present invention relates to a method to improve the wear resistance of the surfaces of cylinders or cylinder liners of internal combustion engines, and more particularly to improve the wear resistance of cast cylinders or cylinder liners made of low-phosphor cast iron, and hardened by laser beams.

BACKGROUND

Methods of hardening cylinders or cylinder liners in which pistons of reciprocating internal combustion engines (ICE) operate have previously been proposed—see, for example, U.S. Pat. No. 4,093,842. The referenced publication describes the use of high-power carbon dioxide lasers to hardening cast iron.

Cylinders or cylinder liners or cylinder sleeves which have been hardened in accordance with prior art methods provide for hardening tracks which are close to each other or which overlap. Internal or inherent tension stresses will result in the region between two hardening tracks or in the overlap region. These stresses may be so great that, during operation of the ICE. fissures will occur in the walls of the cylinder or cylinder liner or sleeve. Such fissures may have a length of up to several centimeters. These fissures occur after hardening and subsequent honing of the cylinder walls or the liners or sleeves.

The method of hardening the cylinder surfaces or the surfaces of the liners or sleeves is essentially this: The cylinders or the liners are made of cast iron which is low in phosphor.

(a) The cylinder bore is first prepared for subsequent hardening by metal removal operations, for example on a lathe or boring machine, followed by honing. The metal removal processes are carried out until the cylinder bore, in the region to be hardened, has a diameter which is preferably about 0.02 to 0.05 mm smaller than the eventually desired final diameter. The surface of the cylinder bore will have a roughness RZ 0.015 mm±0.003 mm.

(b) As the next step, an absorption substance is applied to the surface to be hardened, which will lower the reflection of laser light to a few percent.

(c) The third step in the process is the hardening of the cylinder bore in the region under question, by means of a laser beam, such that hardening tracks with martensitic structure in the edge zone of the cast iron will result.

A typical hardening laser is a 5 kw carbon dioxide laser. The laser beams are so guided with respect to the wall of the cylinder bore or the wall of the liner that parallel, helically progressing hardening tracks will result. This is achieved by rotating the cylinder or the cylinder bore relatively to the laser while, additionally, providing for longitudinal feed of the cylinder or cylinder bore or of the laser, respectively. The longitudinal feed and the speed of rotation are so matched that the pitch of the helical tracks of the laser beam will have the appropriate value to place the laser beam tracks where desired.

The laser beam is preferably formed in an integrator which provides a hardening track of essentially rectangular cross section and a uniform distribution profile of beam intensity for hardening. The hardening depth can be controlled and, preferably, is between about 0.5 mm to 1.3 mm.

THE INVENTION

It is an object to improve the known process such that fissures which might arise during operation of an ICE are avoided.

Briefly, in accordance with the invention, the laser beam is guided, relatively to the wall of the cylinder or of the cylinder liner, such that hardening tracks will result which have an edge spacing X between adjacent tracks which is of such dimension that tension stresses which occur during operation of the ICE will have maxima spaced by a distance k from the edge of the hardening track, which tension stresses cannot overlap, by satisfying the condition that X is at least equal to or larger than 2 k, that is, the edge spacing between adjacent tracks is twice the distance of the maxima of the hardening track of the stresses. This arrangement is obtained by so guiding the laser beams with respect to the cylinder bore or the cylinder liner bore that it is applied at an acute angle with respect to the axis of the cylinder, and the tracks are spaced to meet the above-described condition of X being greater than 2 k.

DETAILED DESCRIPTION

Figure 1:
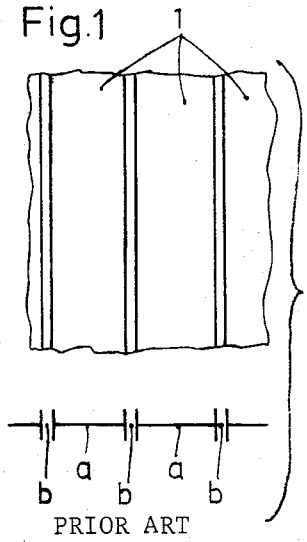
FIGS. 1, 2 and 3 illustrate examples of known arrangements of hardening tracks applied by laser-beam hardening of walls of cylinder or cylinder liner bores.
Figure 2:
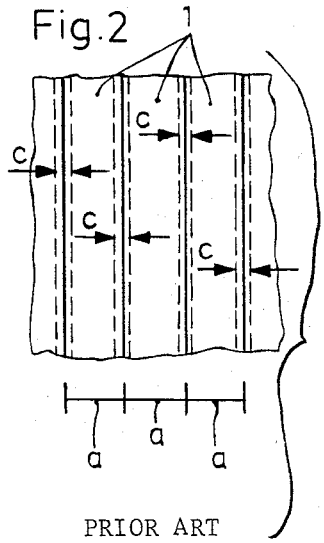
PRIOR ART Fig.2
Figure 3:
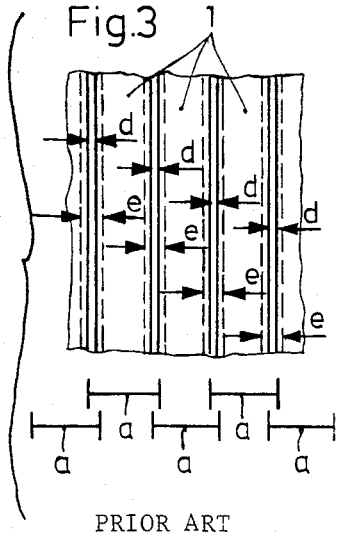
PRIOR ART Fig.3

Hardening tracks 1—see FIGS. 1, 2 and 3—have a width a and are arranged with respect to each other in various ways. All three known arrangements have been found to result, in operation, in fissures in the material.

The arrangement of FIG. 1 provides for hardening tracks which are spaced from each other. The spacing is narrow, however, and not so wide to prevent overlap of internal material stresses of tracks from influencing each other, that is, from becoming superposed. The track width is shown inthe diagram of FIG. 1 as a, in which each track is spaced from an adjacent one by a spacing gap b. The spacing gap b between adjacent tracks 1 is too small to prevent such overlap.

It has also been proposed to fit the tracks exactly against each other—see FIG. 2. The hardening tracks 1, then, will influence each other even more than in the embodiment of FIG. 1, since internal material stresses which occur within the zone c of the edges will definitely superpose from adjacent tracks.

The arrangement of FIG. 3 is even worse in that the hardening tracks 1 overlap in their edge zones. The overlap regions are shown at d, and the regions in which stresses will overlap are shown at e. Overlap of two adjacent hardening tracks provides for strongest mutual influencing of internal stresses since, usually, the maximum stresses will coincide and thus become additive.

In accordance with a feature of the invention, and in order to prevent internal stresses of the hardening tracks to interfere with the hardening of the liners as a whole, the laser beams are guided relative to the wall of the cylinder 2 (FIG. 4) to obtain hardening tracks 4 which are parallel to each other and extend at an inclination to the longitudinal axis 3 of the cylinder and form an acute angle $\alpha$ with the axis 3. The angle $\alpha$ is not critical and. preferably, is within the range of about 10° to 60°.

Figure 4:
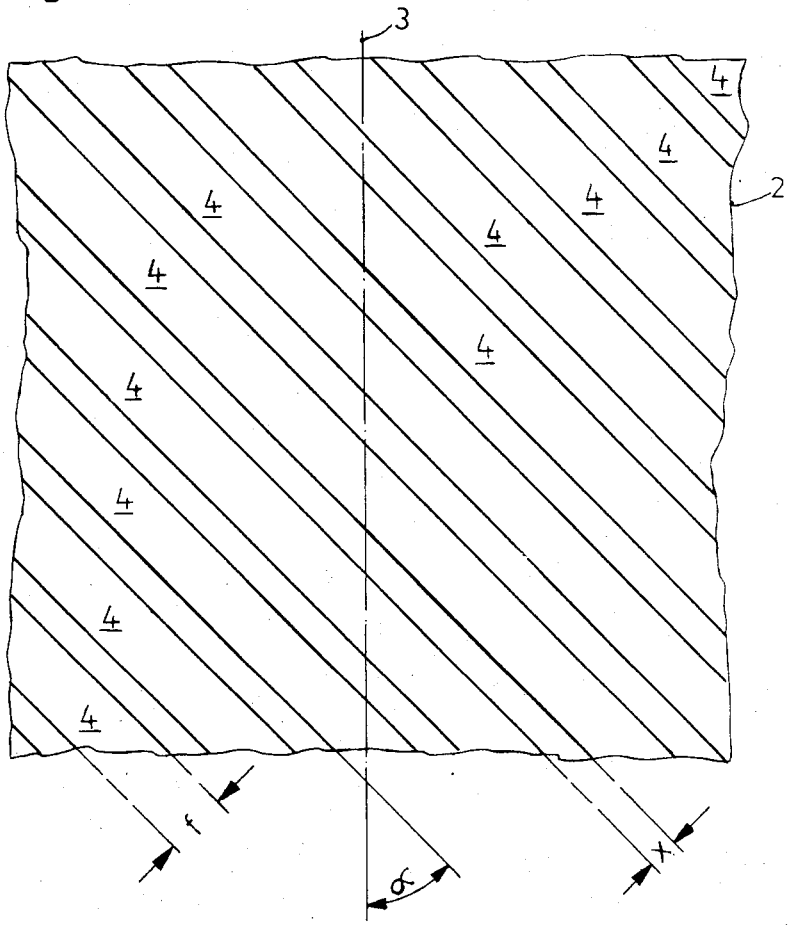
PRIOR ART Fig.4
FIG. 4 is a schematic illustration of an arrangement for applying hardening tracks in accordance with the present invention.

FIG. 4 illustrates a portion of the side wall of the cylinder in developed view. According to a further criterion in accordance with a feature of the invention, the spacing of the hardening tracks 4 is so selected that an edge gap X is provided which is of such a value that the maxima of stresses which occur in operation, that is, the internal stresses due to hardening plus stresses due to engine operation such as, for example, thermal stresses, and which are spaced by a distance k from the edge of the hardening track, cannot coincide. The mathematical condition that X is greater than $2\times k$ must be satisfied (see FIG. 5). The width f of the hardening tracks 4 extending at an angle of inclination with respect to the axis 3 of the cylinder can be freely selected, and can be matched to the requirements of the particular material, availability of lasers, and the like.

According to the present invention, then, the steps of the prior art (a)-(c) are carried out as before with this modification, in accordance with the invention: The tracks are placed as illustrated and described in connection with FIG. 4 and to meet the requirement that X is greater than 2 k.

After carrying out steps (a)-(c), in which the step (c) is in accordance with the present invention, a further step is used:

(d) After hardening by the laser beam, the walls 2 of the cylinder or the cylinder liner are honed to the final diameter to obtain the cylinder surfaces desired. That portion of the material or slight elevations and the like are removed which results upon hardening by structural change into the martensitic structure. The result will be walls for the piston which have adjacent hardness tracks, preferably with a surface roughness RZ 0.006 mm$\pm$0.003 mm and $R_3Z$ 0.002 mm to 0.004 mm. Depending on use, it may be suitable to temper the walls 2, in order to render the level of the inherent or internal material tensions uniform, and to prevent formation of remaining austenite, at least in part. Tempering can be carried out at a temperature of about 200° C. for five or more hours. This lowers tension peaks and results in an overall lower inherent stress level.

Figure 5:
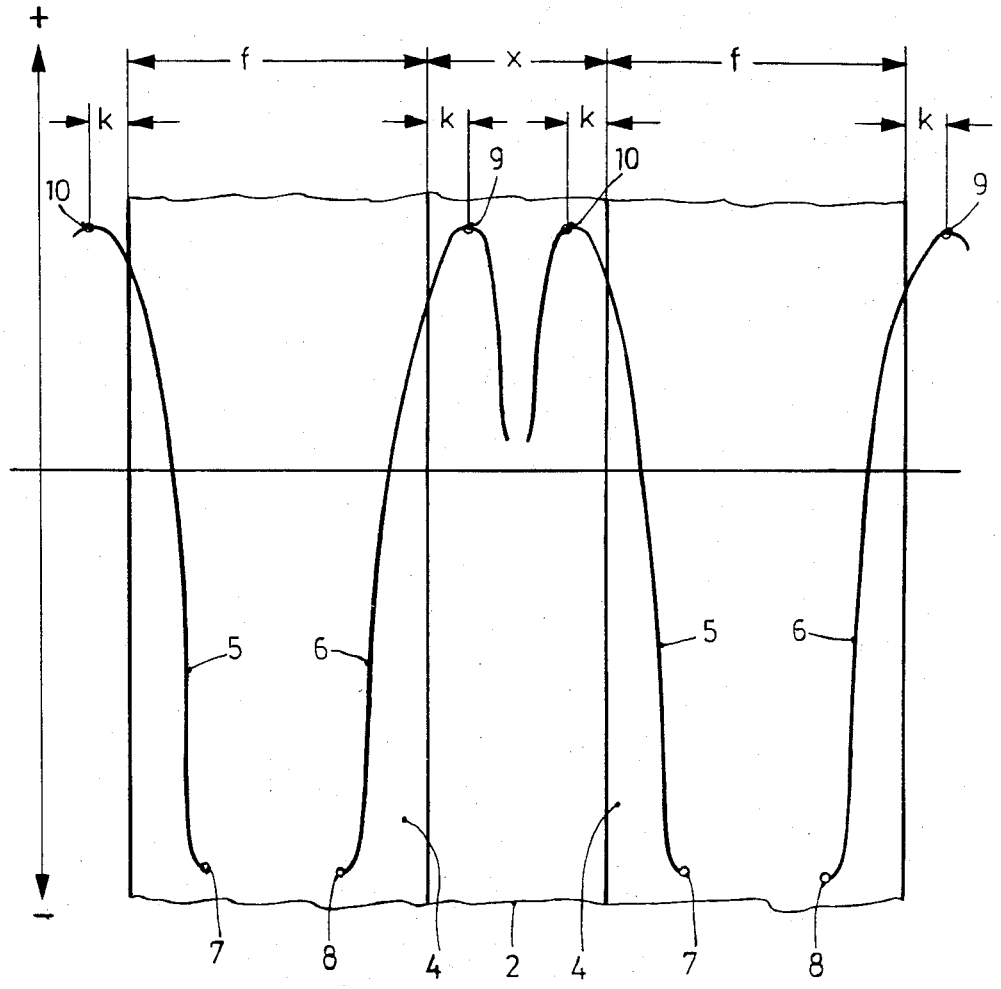
FIG. 5 is a strain-stress diagram which illustrates tension stresses within the material structure defining the cylinder walls and illustrating the stresses with respect to two hardening tracks.

Placing the hardening tracks 4 (FIG. 4) in accordance with the invention at an inclination to the axis of the cylinder 3, with a spacing gap X between two adjacent hardening tracks in accordance with the relationship X is greater than 2 k, will result in stresses which are shown, diagrammatically, in FIG. 5. The strain pressure diagram of FIG. 5 illustrates hardening tracks applied perpendicularly to the abscissa, in which the hardening tracks 4 are shown for comparison. The ordinate, in positive direction, shows the tension stresses which occur in the wall 2 of the cylinder or cylinder liner; the graphs in negative direction show the pressure stresses. The stresses, themselves, which occur in operation of the ICE, vary continuously in sign within the wall of the cylinder and are shown, in the diagram of FIG. 5, by the stress lines 5, 6. It can be clearly seen that the maxima of pressure stress 7, 8 of the respective curves 5, 6 are within the hardness track 4. The tension stresses, however. are not placed within the hardness tracks 4 but, rather, outside thereof in the non-hardened region of the wall 2 of the cylinder or the liner, in which region the maxima 9, 10 of the stress curve 5, 6 are spaced by the distance k from the edge of the hardening tracks 4. These tension maxima 9, 10 differ in accordance with the material of the cylinder or cylinder liner, the depth of hardening and the like, but are always located by some distance k which is less than or equal to 2 mm from the edge of the hardening track 4.

By placing the hardening tracks in accordance with the invention, namely such that the gap between two adjacent hardening tracks 4 is not less than 2 k, the tension curves 5, 6 can never overlap, and the maxima 9, 10 cannot overlap either, so that they can result in harmful additive effects, resulting in fissures within the walls due to excessive tension stress in the walls of the cylinder or the liner. The gap spacing X between two adjacent hardening tracks 4 thus must always be greater than 2 k. This insures that, in operation of the ICE, neither microfissures nor tears or macrofissures will occur in the wall of the cylinder or the cylinder liner. Preferably, the laser operates according to the principle of an integrator, and generates hardening tracks 4 which have an essentially rectangular hardening profile of uniform and adjustable width, with a hardening depth of up to about 1.3 mm.

We claim:

1. Method of improve the wear resistance of running surfaces of cylinders or cylinder liners, made of cast iron, for an internal combustion engine, in which the cylinder bore is machined to a diameter which is slightly less than the desired final diameter and the cylinder bore wall is subsequently hardened by impinging a laser beam thereon, wherein an absorption substance is applied to the surface of the cylinder bore which has the characteristic of lowering the reflection of laser light to provide for absorption of energy furnished by the laser beam, and the cylinder bore wall is hardened by impinging the laser beam on the cylinder bore and relatively moving the laser beam and the bore wall in a track pattern to obtain hardened tracks (4) in which the edge zones will have martensitic structure and, after hardening, the wall of the cylinder bore is honed to the final desired diameter, wherein the step of hardening the cylinder bore wall by the laser beams is carried out by guiding the laser beam in hardening tracks (4) extending parallel to each other along the wall (2) of the cylinder or the cylinder liner, and at an inclination with an acute angle ($\alpha$) with respect to the axis of the cylinder (3), said laser beam causing internal tension stresses to arise adjacent the hardening tracks within the material of the cylinder bore proximate to the cylinder bore walls;

and wherein the hardening tracks (4) are applied to leave a spacing or gap X between the edges of the two adjacent hardening tracks (4), which spacing is so dimensioned that the maxima (9, 10) of internal tension stresses occurring in the cylinder walls cannot overlap, said maxima of tension stresses being spaced by a distance L from the respective edges of the adjacent hardening tracks (4), and wherein X is greater than 2 k.

2. Method according to claim 1, wherein the hardening tracks (4) are sequentially generated, one after another, extending parallel to each other by a laser operating according to the principle of an integrator, the hardening tracks (4) have an essentially rectangular hardening profile, have uniform, adjustable width, and the hardening depth generated by the laser is up to about 1.3 mm.

3. Method according to claim 1 wherein the angle ($\alpha$) of the hardening tracks with respect to the axes of the cylinder (3) is between about 10° to 60°.

4. Method according to claim 1 wherein the spacing or gap X between the edges of the two adjacent hardening tracks is at least about 4 mm.

5. Method according to claim 3 wherein the spacing or gap X between the edges of two adjacent hardening tracks is at least about 4 mm.

* * * * *